US011584602B1

(12) United States Patent
Bearden et al.

(10) Patent No.: US 11,584,602 B1
(45) Date of Patent: Feb. 21, 2023

(54) HOLDING SYSTEMS AND METHODS

(71) Applicant: Southwire Company, LLC, Carrollton, GA (US)

(72) Inventors: Roy Savoy Bearden, Temple, GA (US); Sarah Ashley Strandell, Park Ridge, IL (US); Timothy Francis Reid, Newnan, GA (US)

(73) Assignee: Southwire Company, LLC, Carrollton, GA (US)

( * ) Notice: Subject to any disclaimer, the term of this patent is extended or adjusted under 35 U.S.C. 154(b) by 185 days.

(21) Appl. No.: 17/098,891

(22) Filed: Nov. 16, 2020

Related U.S. Application Data

(62) Division of application No. 15/698,738, filed on Sep. 8, 2017, now Pat. No. 10,836,597.

(60) Provisional application No. 62/509,726, filed on May 22, 2017.

(51) Int. Cl.

| | |
|---|---|
| ***B65H 16/04*** | (2006.01) |
| ***B65H 49/32*** | (2006.01) |
| ***B65H 16/06*** | (2006.01) |

(52) U.S. Cl.
CPC ..... *B65H 16/04* (2013.01); *B65H 16/06* (2013.01); *B65H 49/325* (2013.01)

(58) Field of Classification Search
CPC ..... B65H 16/04; B65H 16/06; B65H 49/325; B65H 75/185
See application file for complete search history.

(56) References Cited

U.S. PATENT DOCUMENTS

| | | | |
|---|---|---|---|
| 2,650,771 | A | 9/1953 | Marion |
| 2,763,442 | A | 9/1956 | Bruestle |
| 2,904,273 | A | 9/1959 | Turner, Jr. et al. |
| 3,263,937 | A | 8/1966 | Kirilouckas |
| 3,345,005 | A | 10/1967 | Kursinczky |
| 3,993,317 | A | 11/1976 | Flagg |
| 4,012,002 | A | 3/1977 | McDonald et al. |
| 5,238,200 | A | 8/1993 | Ritzenthaler |
| 5,490,640 | A | 2/1996 | Miller |
| 2005/0224627 | A1 | 10/2005 | Stolyar |

FOREIGN PATENT DOCUMENTS

| | | |
|---|---|---|
| GB | 786364 | 11/1957 |
| TW | M314750 | 7/2007 |
| WO | WO 2013/078762 | 6/2013 |

OTHER PUBLICATIONS

DeMar Technologies, LLC., "36" Shaftless Motorized Take-Up, retrieved at http://www.demarmachine.com/36TakeUp.html on May 18, 2017.
U.S. Office Action dated Nov. 29, 2019 in U.S. Appl. No. 15/698,738.
U.S. Office Action dated Apr. 3, 2020 in U.S. Appl. No. 15/698,738.
U.S. Notice of Allowance dated Jul. 23, 2020 in U.S. Appl. No. 15/698,738.

*Primary Examiner* — Sang K Kim
(74) *Attorney, Agent, or Firm* — Hartman & Citrin LLC

(57) ABSTRACT

A holding system and methods, systems, and apparatuses for constructing, assembling, and using the holding system are disclosed. The holding system can include an arbor bushing. The arbor bushing can include a head portion. The holding system can also include a plate attached to the arbor bushing. A pad can be attached to the plate. The head portion of the arbor bushing extends outward beyond a surface of the pad.

11 Claims, 9 Drawing Sheets

HOLDING SYSTEMS AND METHODS

CROSS-REFERENCE TO RELATED APPLICATIONS

This application is a divisional of and claims priority to U.S. patent application Ser. No. 15/698,738, entitled "Holding Systems and Methods," filed Sep. 8, 2017, now U.S. Pat. No. 10,836,597, which is incorporated herein by reference in its entirety and which claims priority to U.S. Provisional Application No. 62/509,726, entitled "Holding Systems and Methods" filed May 22, 2017, which is incorporated herein by reference in its entirety.

BACKGROUND

Take-up and pay-off systems are often used to facilitate the winding of linear elements, such as wires, cables, conductors, rope, and carpet, onto reels and the unwinding of such linear elements from reels. Typically, such take-up and pay-off systems include a mechanism that engages a reel and holds the reel as the reel is lifted off the ground by the take-up and pay-off systems to permit the reel to be rotated, about its axis, by the mechanism. Such rotation allows linear elements to be wound onto the reel and/or unwound from the reel. Aligning the mechanism with the reel to allow the mechanism to engage the reel generally requires human involvement. For instance, many such mechanisms of take-up and pay-off systems include a drive pin that has to be aligned by an operator for insertion within an opening of a reel. However, as the drive pin is moved towards the reel to engage the reel, pinch points occur that make it possible for one or more fingers and/or a hand of the operator to be caught between the reel and the drive pin of the take-up and pay-off systems.

SUMMARY

The present disclosure is directed to a holding system and methods, systems, and apparatuses for constructing, assembling, and using the holding system. According to various embodiments of the concepts and technologies described herein, the holding system can include an arbor bushing. The arbor bushing can include a head portion. The holding system can also include a plate attached to the arbor bushing. A pad can be attached to the plate. The head portion of the arbor bushing extends outward beyond a surface of the pad.

The present disclosure is further directed to a holding system including an arbor bushing and a plate attached to the arbor bushing. The holding system also includes a pad attached to the plate. The pad can include a channel recessed below a surface of the pad.

The present disclosure is further directed to a method of assembling a holding system. A plate can be assembled on an arbor bushing. The arbor bushing can include a head portion. The plate can be fastened to the arbor bushing. A pad can be assembled on the arbor bushing. The pad can be fastened to the plate. The head portion of the arbor bushing can extend outward beyond a surface of the pad.

This Summary is provided to introduce a selection of concepts in a simplified form that are further described below in the Detailed Description. This Summary is not intended to be used to limit the scope of the claimed subject matter. Furthermore, the claimed subject matter is not limited to implementations that solve any or all disadvantages noted in any part of this disclosure.

DETAILED DESCRIPTION

The following detailed description is directed to systems, methods, and apparatuses for holding a reel, spool, or similar device. More particularly, the detailed description is directed to systems, methods, and apparatuses for holding a reel, spool, or similar device without requiring the use of a drive pin. Thus, the systems, methods, and apparatuses described herein eliminate the pinch points caused by the use of drive pins. According to some implementations, a holding system is used to hold a reel and rotate the reel as the holding system is rotated by a take-up and pay-off system to allow one or more linear elements to be wound onto the reel or unwound from the reel. Although the systems, methods, and apparatuses are sometimes described in the aforementioned context in terms of holding and rotating a reel, it should be understood that the systems, methods, and apparatuses described herein may additionally or alternatively be used in other contexts to hold and rotate other devices such as spools, drums, spindles, bobbins, and similar devices. As such, the particular implementations described herein should not be construed as being limiting in any way. This description provides various components, one or more of which may be included in particular implementations of the systems, methods, and apparatuses disclosed herein. In illustrating and describing these various components, however, it is noted that implementations of the embodiments disclosed herein may include any combination of these components, including combinations other than those shown in this description.

Figure 1A:
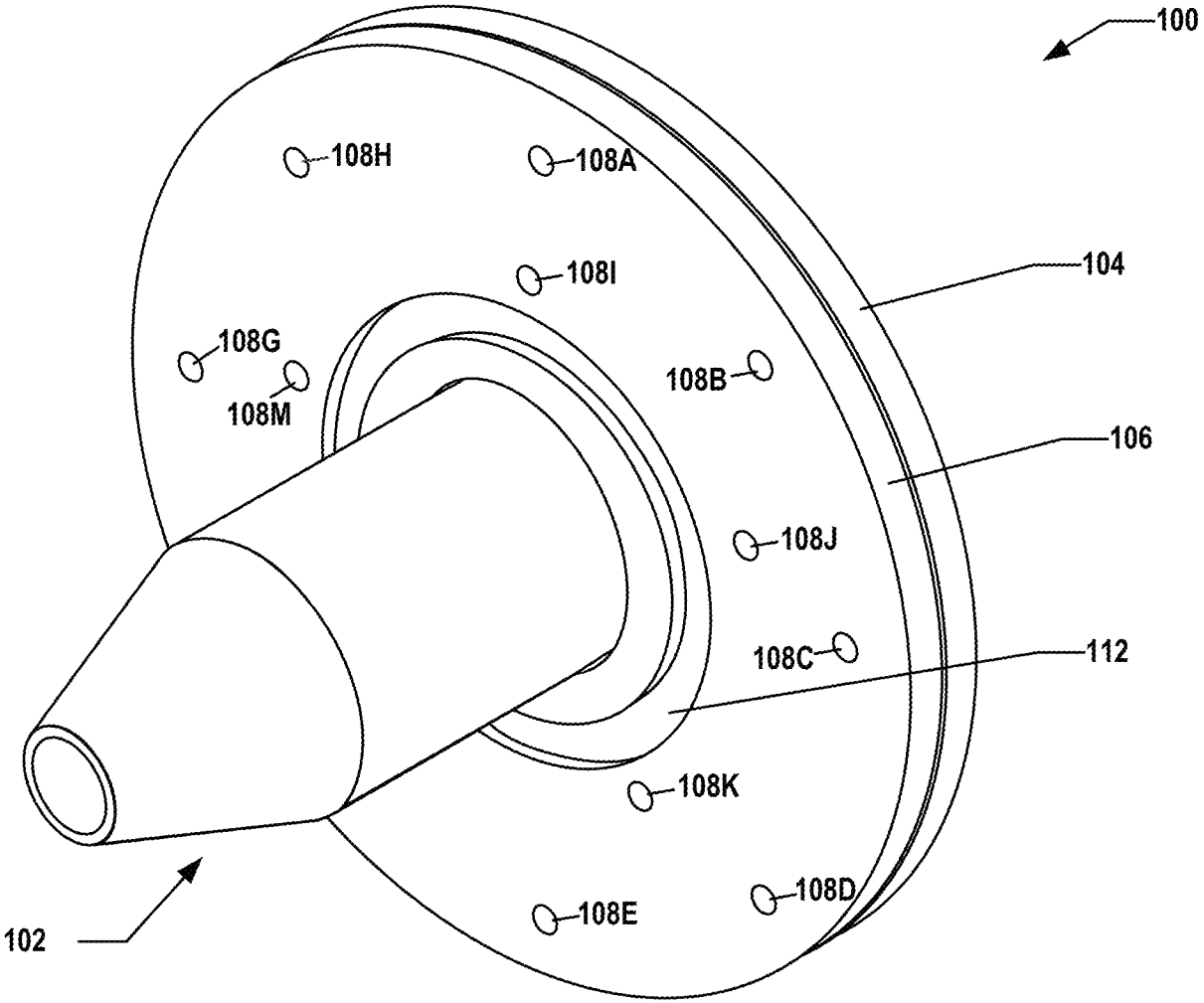
FIG. 1A illustrates a holding system, according to illustrative embodiments.
Figure 1B:
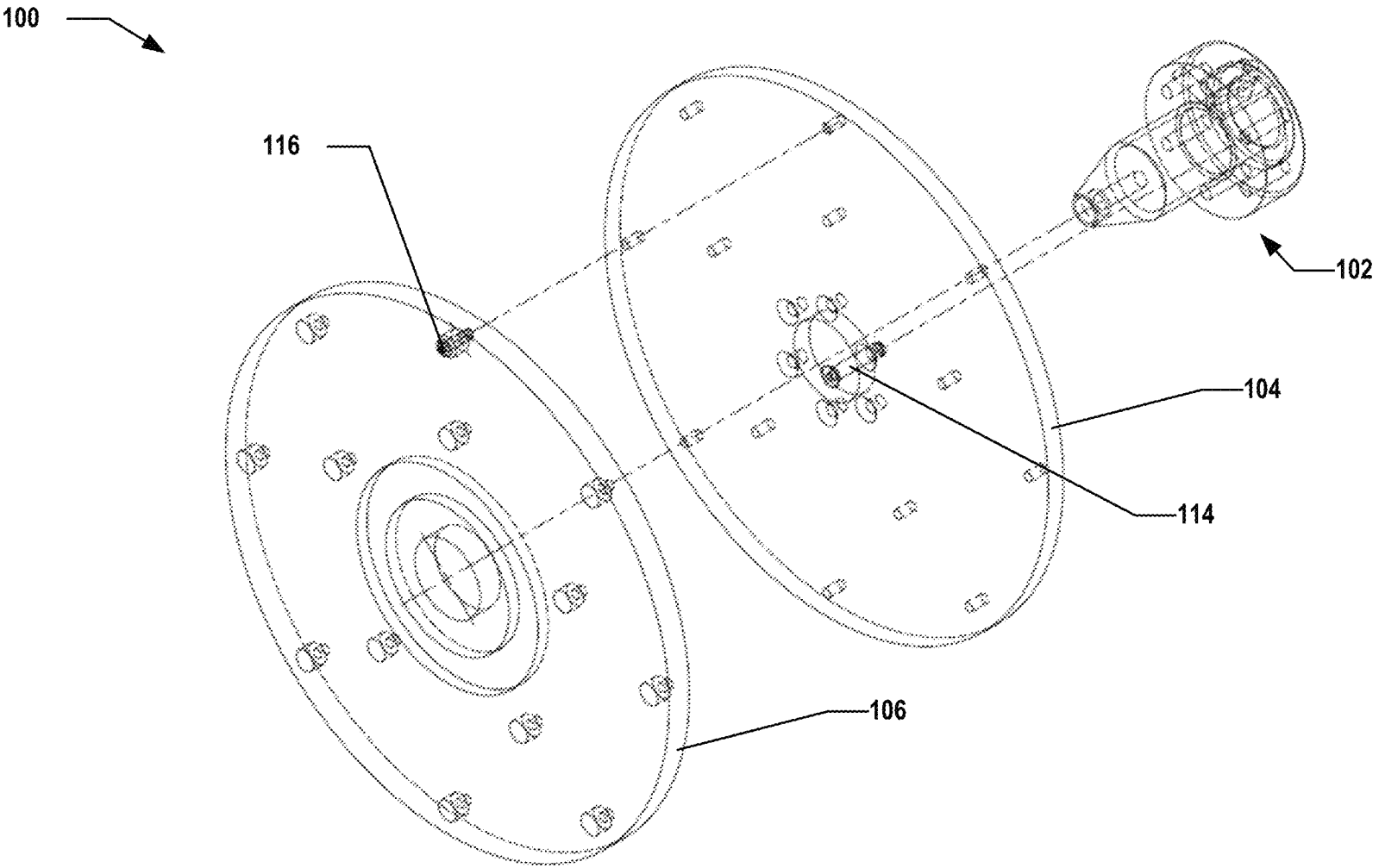
FIG. 1B illustrates an exploded view of the holding system illustrated in FIG. 1A, according to illustrative embodiments.
Figure 1C:
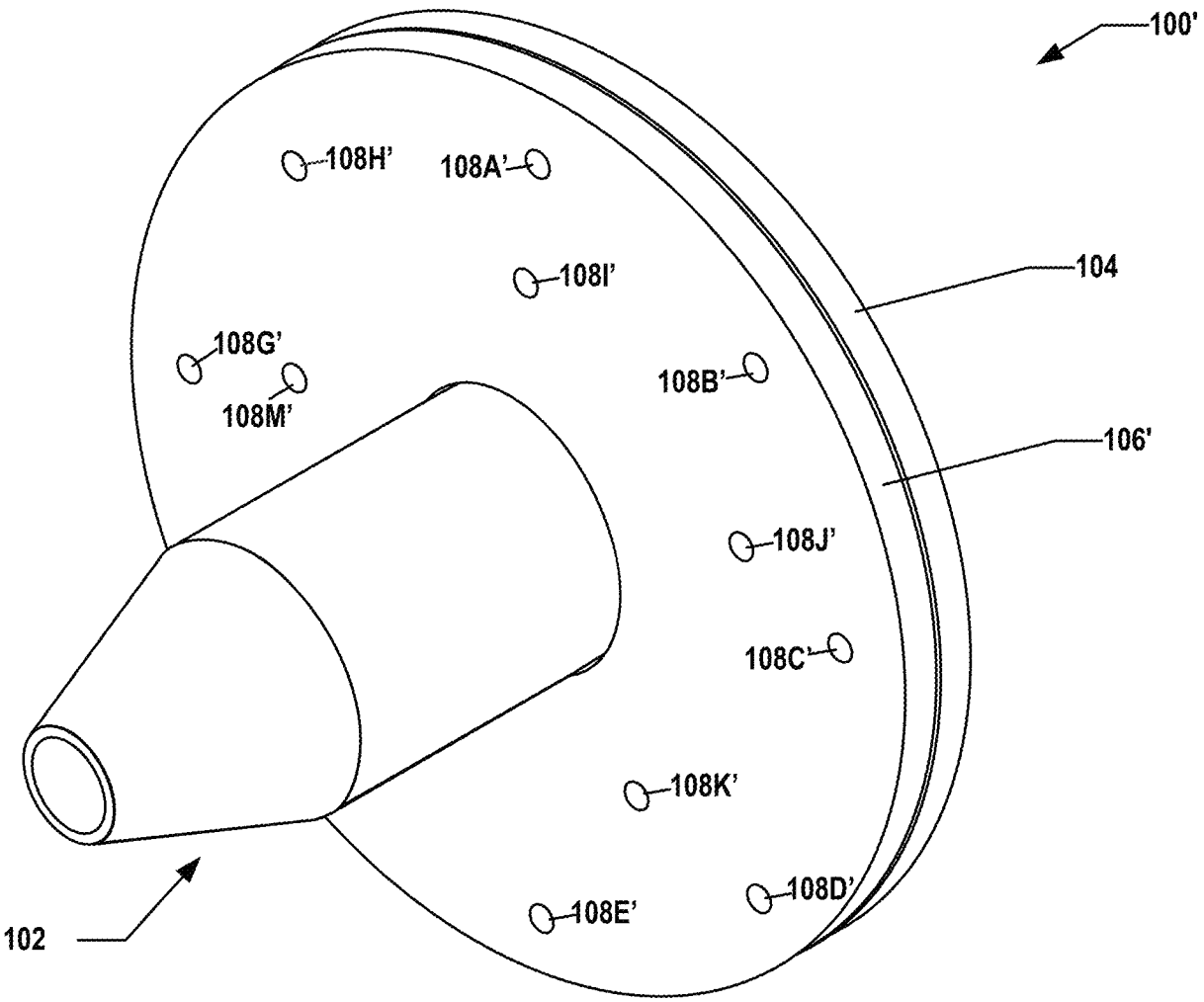
FIG. 1C illustrates a holding system, according to further illustrative embodiments.

FIG. 1A illustrates a holding system 100 in accordance with an illustrative embodiment. According to embodiments, the holding system 100 includes an arbor bushing 102, a plate 104, and a pad 106. FIG. 1B illustrates an exploded view of the holding system 100 shown in FIG. 1A. As discussed further below, the pad 106 of the holding system 100 illustrated in FIGS. 1A and 1B includes a channel 112 recessed below the surface of the pad 106, which will be discussed further below with reference to FIGS. 4A-4C. Alternatively, FIG. 1C illustrates a holding system 100' in accordance with a further illustrative embodiment. According to embodiments, the holding system 100' includes the arbor bushing 102 and the plate 104, similar to the holding system 100 illustrated in FIGS. 1A and 1B. The holding system 100' also includes a pad 106' that, unlike the pad 106 of the holding system 100 illustrated in FIGS. 1A and 1B, does not include the channel 112 or any other recessed and/or raised pattern.

Figure 2B:
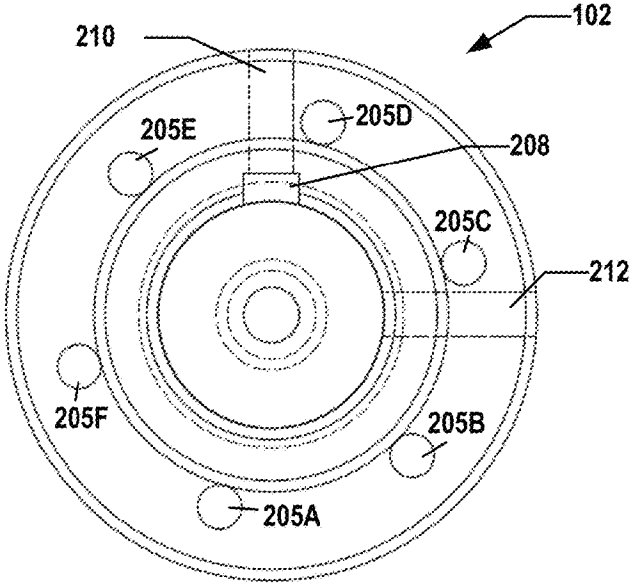
FIGS. 2A-2C illustrate an arbor bushing of the holding system, according to illustrative embodiments.
Figure 2A:
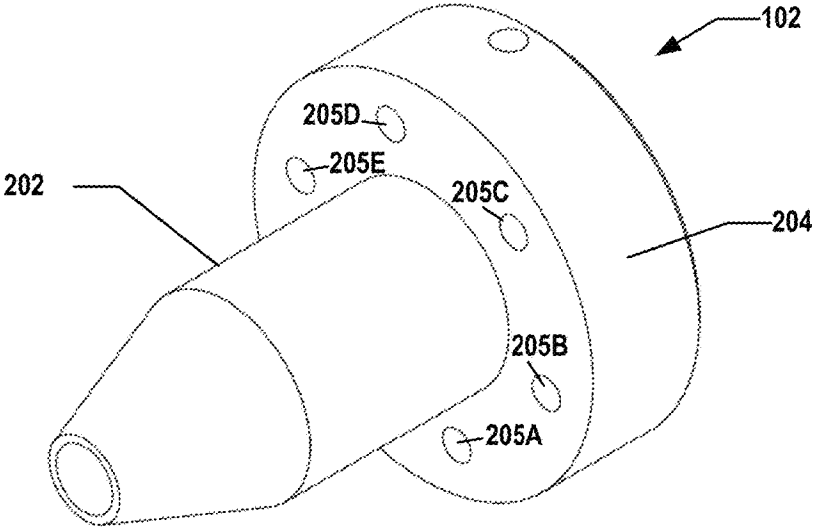
Figure 2C:
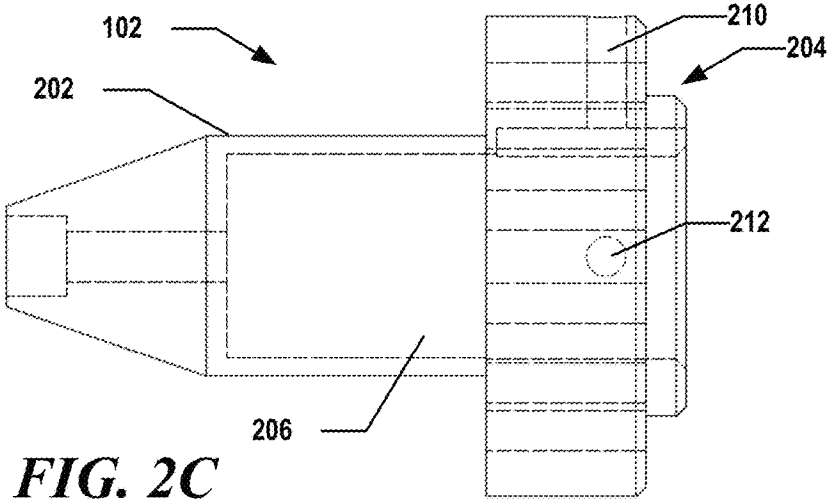

As illustrated in FIGS. 2A-2C, the arbor bushing 102 can include a head portion 202 and a collar portion 204. The head portion 202 and the collar portion 204 can be machined as a single piece. Alternatively, the head portion 202 and the collar portion 204 can be machined as two separate pieces and then joined together by welding, brazing, soldering, or a similar process. The head portion 202 and the collar portion 204 may also be joined using screws, bolts, or any other fastening devices. The arbor bushing 102 may be made of metal, such as steel or aluminum, plastic, or any other durable material capable of holding loaded reels that can weigh up to several tons. The head portion 202 can have a smaller diameter than the collar portion 204.

According to embodiments, the head portion 202 includes a cylindrical part extending outwardly from the collar portion 204. The cylindrical part of the head portion 202 can taper to a truncated cone part, or conical frustum, at the end of the head portion 202 opposite the collar portion 204, as illustrated in FIGS. 2A and 2C. Alternatively, the head portion 202 can be cylindrical in shape throughout its length without tapering to a truncated cone.

The cylindrical part of the head portion 202 can define an internal bore 206. The internal bore 206 can be sized to receive a shaft of a system, such as a take-up and pay-off system 500 illustrated in FIG. 5, to install the holding system 100, shown as holding systems 100A and 100B in FIG. 5, on the take-up and pay-off system 500. To allow the holding system 100 to be used on a plurality of types of take-up and pay-off systems, the diameter of the internal bore 206 of the cylindrical part of the head portion 202 can be sized based on a diameter of the shaft of the particular take-up and pay-off system on which the holding system 100 is to be installed. Additionally, the length of the internal bore 206 can be sized based on a length of the shaft of the particular take-up and pay-off system on which the holding system 100 is to be installed. The truncated cone part of the head portion 202 can also include an internal bore, as illustrated in FIG. 2C.

According to embodiments, the head portion 202 of the arbor bushing 102 of the holding system 100 is inserted within an arbor hole of a reel to engage and hold the reel. The head portion 202 of the arbor bushing 102 of the holding system 100 along with the pad 106/106', as discussed further below, both work to hold the reel as the reel is lifted and rotated by a take-up and pay-off system, such as the take-up and pay-off system 500.

Continuing with FIGS. 2A-2C and according to embodiments, the collar portion 204 of the arbor bushing 102 includes a plurality of holes 205A-205F (also referred to herein collectively as "plurality of holes 205") arranged radially around the center of the collar portion 204. According to embodiments, the plurality of holes 205 are threaded. As will be discussed further with regards to FIGS. 3A-3B, the arrangement of the plurality of holes 205 of the collar portion 204 can match the arrangement of a plurality of holes 302A-302F (also referred to herein collectively as "plurality of holes 302") of the plate 104 of the holding system 100 to allow the plate 104 and the arbor bushing 102 to be fastened together. Although both the plurality of holes 205 of the collar portion 204 and the plurality of holes 302 of the plate 104 illustrated in FIGS. 2A-2C and FIGS. 3A-3B, respectively, include six holes, such an implementation should not be construed as limiting in any way since each of the collar portion 204 and the plate 104 can include more or less holes. In addition, the arrangement of both the plurality of holes 205 of the collar portion 204 and the plurality of holes 302 is exemplary and should not be construed as limiting in any way.

With reference to FIGS. 1B, 2A-2C, and 3A-3B and according to embodiments, the plate 104 can be assembled on the arbor bushing 102 by sliding a center opening 304 of the plate 104 over the head portion 202 of the arbor bushing 102 and aligning the plurality of holes 302 of the plate 104 with the plurality of holes 205 of the collar portion 204 of the arbor bushing 102. Fastening devices 114, such as for example screws, bolts, or studs, can be received into the aligned plurality of holes of both the plate 104 and the collar portion 204 of the arbor bushing 102 to fasten and/or attach the plate 104 to the arbor bushing 102. By attaching the plate 104 and the arbor bushing 102 together via the fastening devices 114, the plate 104 and the arbor bushing 102 can be easily separated to allow the parts to be replaced independently of one another in case of wear and/or damage from use. Alternatively and/or additionally, the plate 104 and the arbor bushing 102 can be joined together by welding, brazing, or soldering.

Turning back to FIGS. 2A-2C, to secure the arbor bushing 102 to the shaft of a take-up and pay-off system, such as the take-up and pay-off system 500, the arbor bushing 102 can include a keyway 208 for receiving a key (not shown) of the shaft of the take-up and pay-off system 500. Additionally and/or alternatively, the collar portion 204 of the arbor bushing 102 can include a hole 210 that can be aligned with a hole (not shown) in the shaft of the take-up and pay-off system 500. A fastening device, such as for example a screw, bolt, or stud, can be received within the aligned holes of the collar portion 204 and the shaft of the take-up and pay-off system 500 to secure the arbor bushing 102 to the shaft of the take-up and pay-off system 500. The collar portion 204 can also include a hole 212 for receiving a set screw. When inserted within the hole 212, the set screw can help maintain the arbor bushing 102 stationary with respect to the shaft of the take-up and pay-off system 500.

Figure 3B:
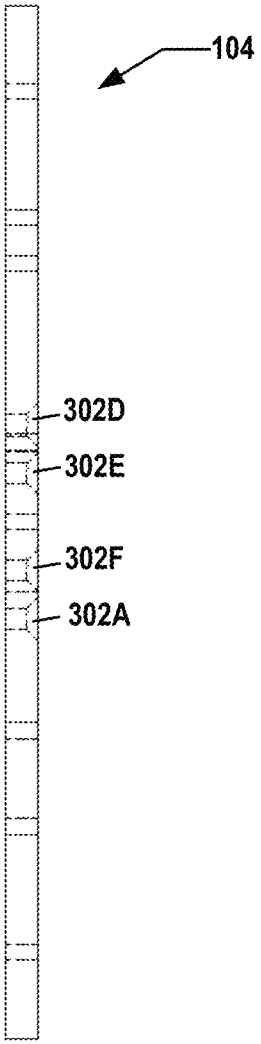
FIGS. 3A-3B illustrate a plate of the holding system, according to illustrative embodiments.
Figure 3A:
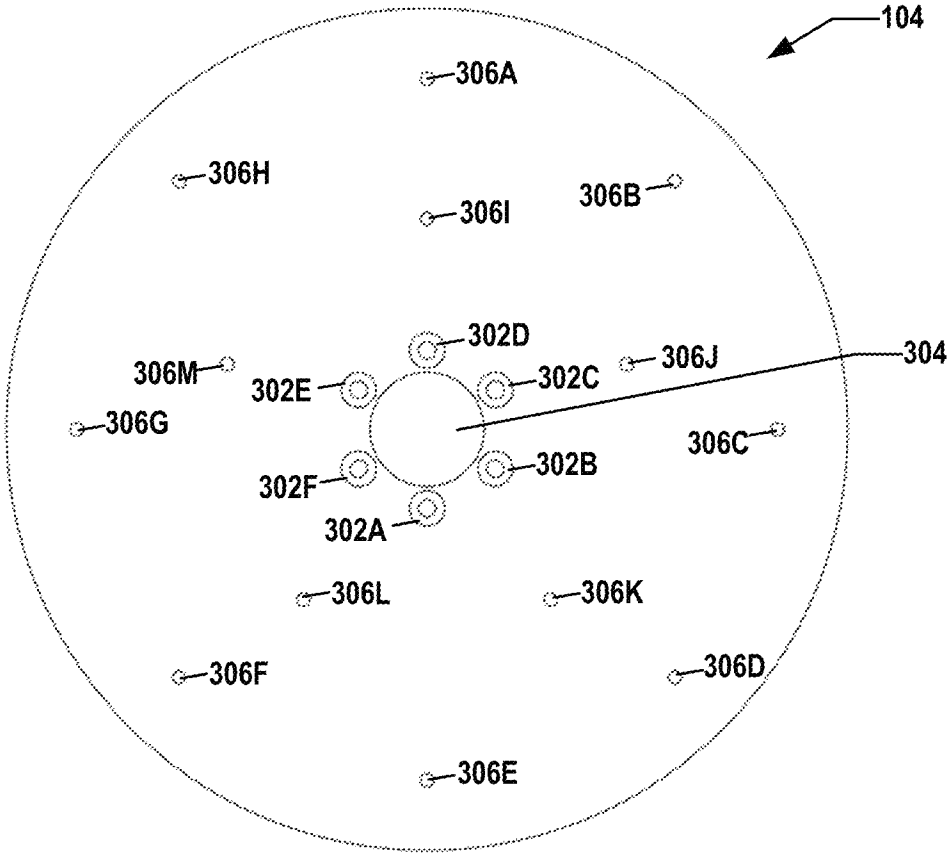

Turning to FIGS. 3A-3B, the plate 104 of the holding system 100 is illustrated. According to embodiments, the plate 104 is circular in shape. The diameter of the plate 104 can be based on the size and/or weight of the reel to be held by the holding system 100. For instance, a plate with a larger diameter can be used for larger and/or heavier reels. According to an embodiment, the plate 104 has a diameter ranging from sixteen inches to twenty-four inches. According to an embodiment, the plate 104 has a thickness of 0.75 inches. The plate 104 can be made from a metal such as, for example, steel or aluminum, hard plastic, or other durable material that is capable of holding reels that can weigh up to several tons.

As discussed above and according to embodiments, the plate 104 includes the center opening 304. With reference to FIG. 1B and FIGS. 3A-3B, the center opening 304 can receive the head portion 202 of the arbor bushing 102 to assemble the plate 104 on the arbor bushing 102. According to embodiments, the plate 104 includes a plurality of holes, such as the plurality of holes 302A-302F (also referred to herein collectively as "plurality of holes 302"). The plurality of holes 302 can be arranged radially around the center opening 304 of the plate 104, as illustrated in FIG. 3A. As discussed above, the arrangement of the plurality of holes 302 of the plate 104 can match the arrangement of the plurality of holes 205 of the collar portion 204 to allow the plate 104 and the arbor bushing 102 to be fastened together.

The plate 104 can also include a plurality of holes 306A-306M (also referred to herein collectively as "plurality of holes 306"). According to embodiments, the arrangement of the plurality of holes 306 of the plate 104 can match the arrangement of a plurality of holes 108A-108M (also referred to herein collectively as "plurality of holes 108") of the pad 106 of the holding system 100, illustrated in FIGS. 1A-B and 4A-4C, to allow the plate 104 and the pad 106 to be fastened together via the aligned plurality of holes. The arrangement of a plurality of holes 108A'-108M' (also referred to herein collectively as "plurality of holes 108") of the pad 106' illustrated in FIG. 1C can similarly match the arrangement of the plurality of holes 306 of the plate 104 to allow the plate 104 and the pad 106' to be fastened together. Although the plurality of holes 108 of the pad 106, the plurality of holes 108' of the pad 106', and the plurality of holes 306 of the plate 104 illustrated in FIGS. 1A-1C and 4A-4C, include thirteen holes, such an implementation should not be construed as limiting in any way since each can include more or less holes. In addition, the arrangement of the plurality of holes 108 of the pad 106, the plurality of holes 108' of the pad 106', and the plurality of holes 306 of the plate 104 is exemplary and should not be construed as limiting in any way.

According to embodiments, the plurality of holes 108/108' of the pad 106/106' can be aligned with the plurality of holes 306 of the plate 104. Fastening devices 116, such as for example screws, bolts, or studs, can be received into the aligned plurality of holes of both the pad 106/106' and the plate 104 to fasten and/or attach the pad 106/106' to the plate 104. By attaching the pad 106 and the plate 104 together via the fastening devices 116, the pad 106 and the plate 104 can be easily separated to allow the parts to be replaced independently of one another in case of wear and/or damage from use. Alternatively and/or additionally, the pad 106 can be attached to the plate 104 using glue, tape, or some other similar adhesive.

Either before or after attaching the pad 106/106' to the plate 104, the pad 106/106' can be assembled over the head portion 202 of the arbor bushing 102. According to embodiments, after the plate 104 is assembled over the head portion 202 of the arbor bushing 102 and fastened to the arbor bushing 102, a center opening 110 of the pad 106/106' is slid over the head portion 202 of the arbor bushing 102 to assemble the pad 106/106' on the arbor bushing 102. The pad 106/106' can then be fastened to the plate 104 to assemble the holding system 100/100'. When the holding system 100/100' is assembled, the head portion 202 of the arbor bushing 102 extends outward beyond the surface of the pad 106/106' to allow the head portion 202 to receive an arbor hole of a reel, as discussed further below.

Figure 4A:
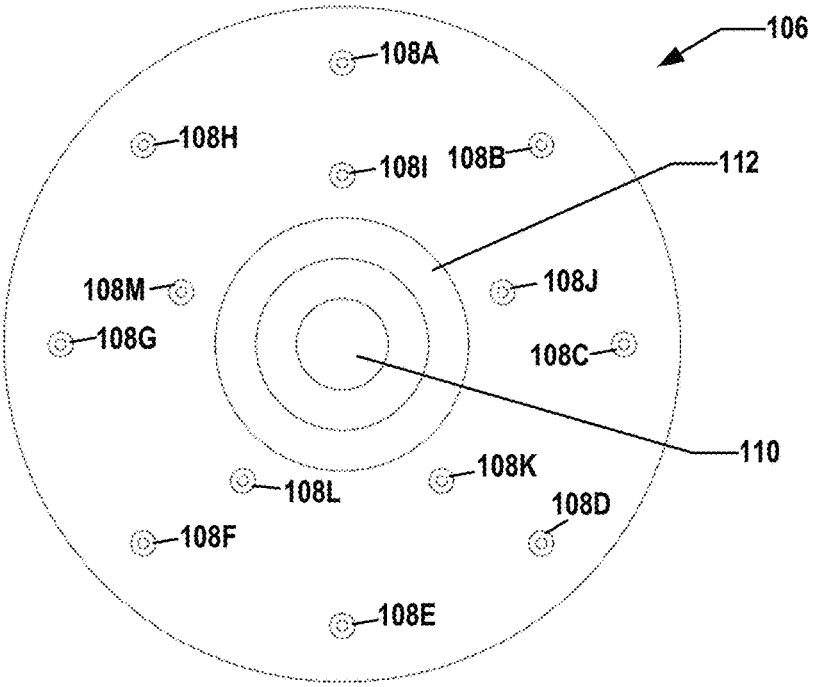
FIGS. 4A-4C illustrate a pad of the holding system, according to illustrative embodiments.
Figure 4B:
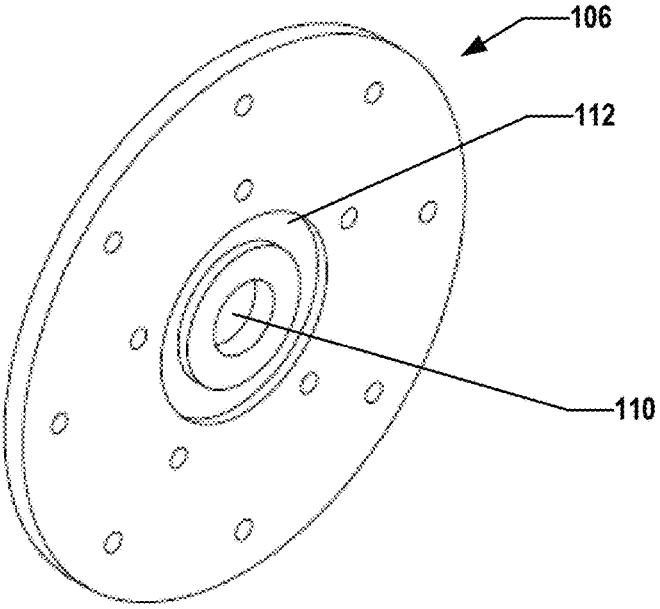
Figure 4C:
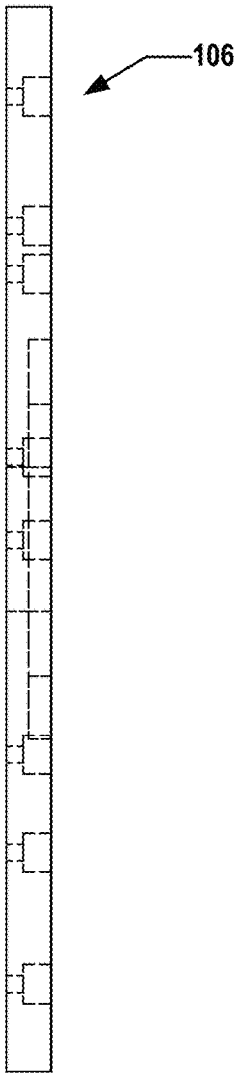

Turning now to FIGS. 4A-4C, the pad 106 of the holding system 100 is illustrated and discussed in further detail. According to embodiments, the pad 106 is circular in shape. The diameter of the pad 106 can be based on the size and/or weight of the reel to be held by the holding system 100. For instance, a pad with a larger diameter can be used for larger and/or heavier reels. According to embodiments, the diameter of the pad 106 is substantially similar to the diameter of the plate 104. According to an embodiment, the pad 106 has a diameter ranging from sixteen inches to twenty-four inches. According to an embodiment, the pad 106 has thickness of one inch. The pad 106 can be made from a polymer such as silicone, natural rubber, synthetic rubber, plastic, or any other material that has a coefficient of friction capable of maintaining contact between the reel and the pad 106, especially as the holding system 100 is rotating. According to embodiments, the material used for the pad 106 is based on the material of the reel. For instance, a reel made of wood may require a material with a higher coefficient of friction than a reel made of steel since the surface of a wood reel is uneven versus the surface of a steel reel. The pad 106 can be molded, cut from a larger piece of material, built via a computer numerical control machine, printed by a 3D printer, or any other similar method.

According to embodiments, the pad 106 includes a plurality of holes, such as the plurality of holes 108A-108M (also referred to herein collectively as "plurality of holes 108"). The arrangement of the plurality of holes 108 of the pad 106 can match the arrangement of the plurality of holes 306 of the plate 104 to allow the pad 106 and the plate 104 to be fastened together. As discussed above and according to embodiments, the pad 106 includes the center opening 110. After the plate 104 is assembled over the head portion 202 of the arbor bushing 102 and fastened to the arbor bushing 102, the center opening 110 of the pad 106 is slid over the head portion 202 of the arbor bushing 102 to assemble the pad 106 on the arbor bushing 102. The pad 106 can then be fastened to the plate 104, via the plurality of holes 108, to assemble the holding system 100/100'.

According to some embodiments, and as illustrated in FIGS. 1A-1B and 4A-4C, the pad 106 includes a channel, such as the channel 112, recessed below the surface of the pad 106. Many reels include a plurality of bolts, ridges, spokes, or other structures that extend outward beyond the surface of the reel. The channel 112 of the pad 106 receives the bolts, ridges, spokes, or any other structures extending outward from the surface of the reel when the reel is moved in contact with the pad 106 of the holding system 100. Thus, the bolts, ridges, spokes, and other structures extending from the surface of the reel do not jab and puncture the pad 106 since the channel is recessed below the surface of the pad 106 to receive the bolts and any other structures extending outward from the surface of the reel. As the holding system 100 is rotated and correspondingly rotates the reel, the channel 112 keeps the bolts or other structures extending from the surface of the reel from tearing and ripping the pad 106. The pattern and position of the channel 112 should not be construed as limiting in any way. Any type of recessed or raised pattern can be included on the pad 106 in any position, depth of recess, variety of depths of recess, or arrangement needed in order to receive structures that extend beyond the surface of the reel. According to other embodiments, the holding system 100 includes the pad 106' without the channel 112 or any other recessed and/or raised pattern, as illustrated in FIG. 1C.

Figure 5:
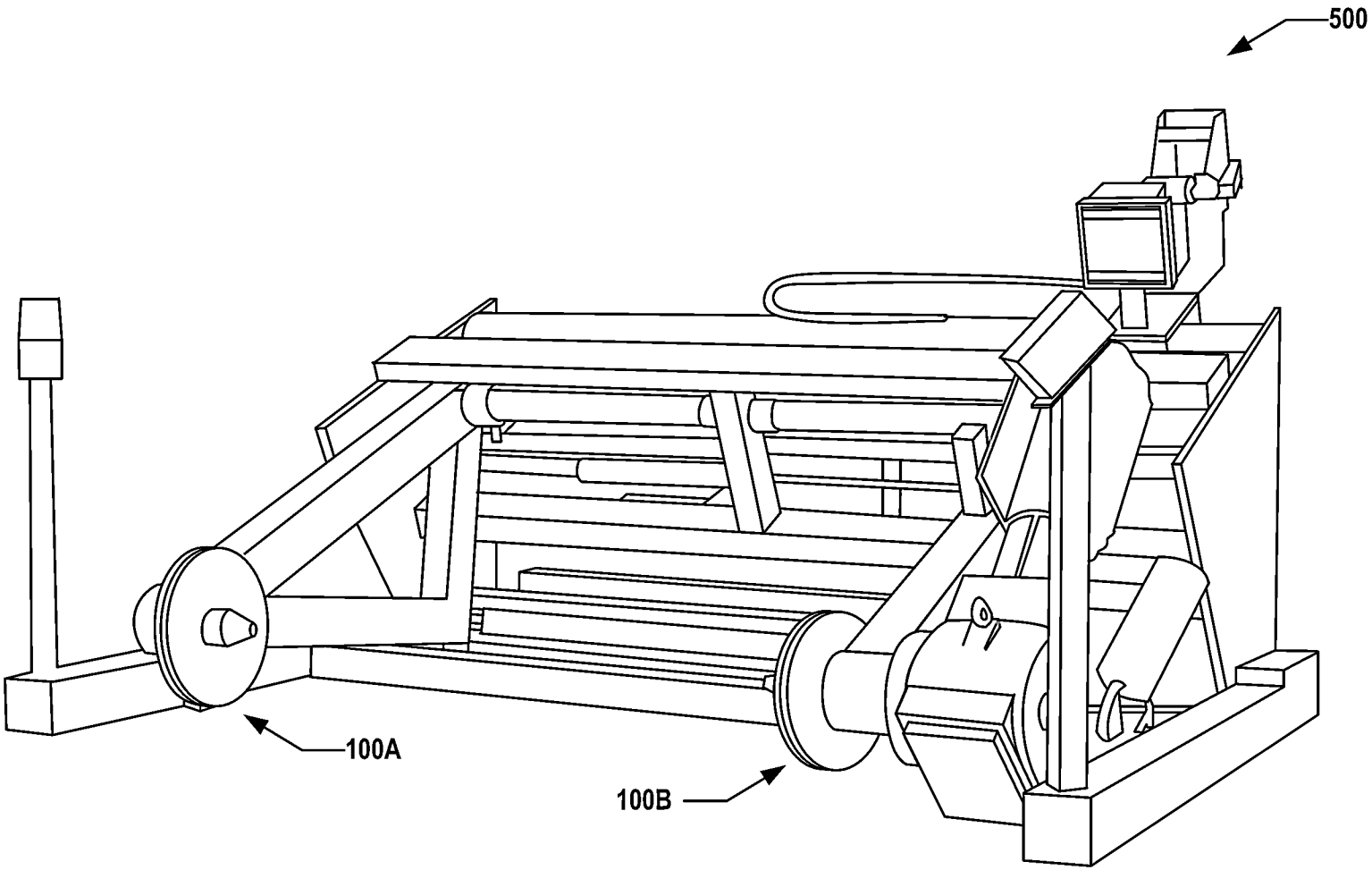
FIG. 5 illustrates a take-up and pay-off system including the holding system, according to illustrative embodiments.

Turning now to FIG. 5, an exemplary take-up and pay-off system 500 is illustrated including the holding system 100, illustrated as the holding systems 100A and 100B, in accordance with an illustrative embodiment. As discussed above, the take-up and pay-off system 500 may include shafts (not shown) on which the holding systems 100A and 100B are installed. According to embodiments, a reel is positioned between the holding systems 100A-100B. The holding systems 100A-100B can be moved inward and/or upward to align the head portion 202 of each of the holding systems 100A-100B with arbor holes of the reel. According to embodiments, the holding systems 100A-100B can be aligned with the reel without requiring human involvement. As used herein, the term "human involvement" means human contact with the reel or the holding system. Thus, the pinch points caused by human involvement required for systems with drive pins are eliminated.

The holding systems 100A-100B can continue to be moved inward to allow the head portions 202 to be inserted within the arbor holes of the reel and to allow the reel to come into contact with the pad 106/106' of each of the holding systems 100A-100B. As the take-up and pay-off system 500 lifts the reel and begins to rotate one or more of the holding systems 100A-100B, the arbor bushing 102 and the pad 106/106' of each of the holding systems 100A-100B hold the reel and facilitate rotation of the reel. By eliminating the drive pins, the holding system 100 eliminates the pinch points caused by the need to align the drive pins for insertion within openings of reels.

Figure 6:
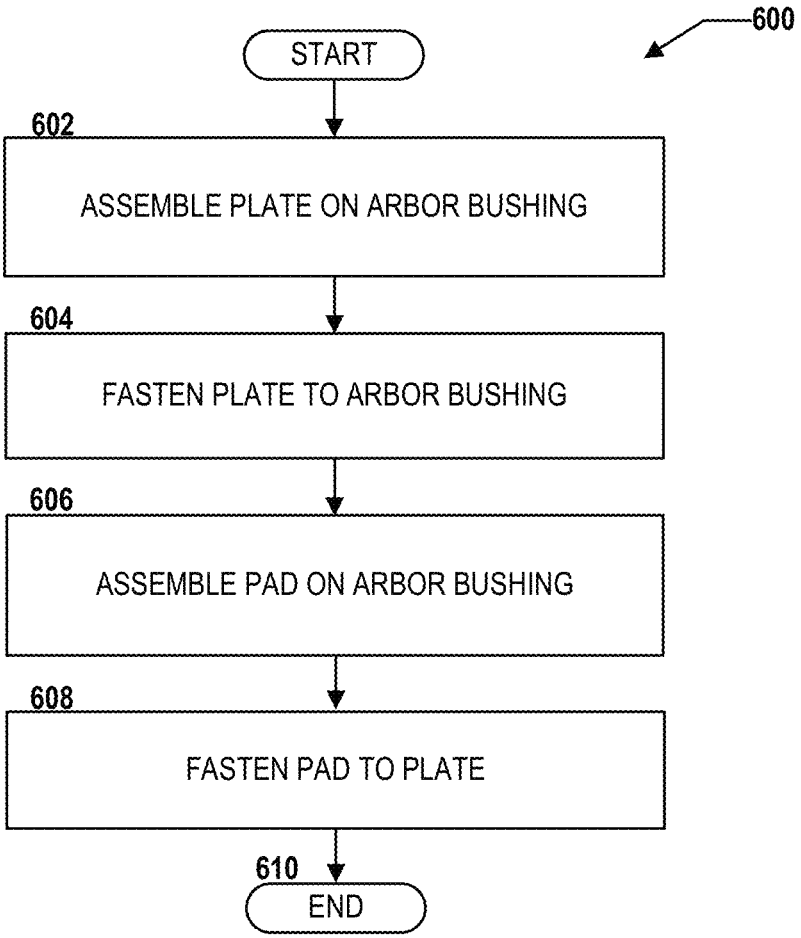
FIG. 6 is a flow diagram illustrating aspects of a method of assembling the holding system, according to illustrative embodiments.

Turning now to FIG. 6, a method 600 for assembling the holding system 100 will be described, according to an illustrative embodiment. It should be understood that the operations of the methods disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the concepts and technologies disclosed herein. It also should be understood that the methods disclosed herein can be ended at any time and need not be performed in its entirety.

The method 600 begins at operation 602, where the plate 104 is assembled on the arbor bushing 102. According to embodiments, the center opening 304 of the plate 104 is slid over the head portion 202 of the arbor bushing 102 until the plate 104 contacts the collar portion 204 of the arbor bushing 102 to assemble the plate 104 on the arbor bushing 102. Thus, the head portion 202 of the arbor bushing 102 is inserted into the center opening 304 of the plate 104 to place the plate 104 in contact with the collar portion 204 of the arbor bushing 102. From operation 602, the method 600 proceeds to operation 604, where the plate 104 is fastened to the arbor bushing 102. According to embodiments, the plurality of holes 302 of the plate 104 are aligned with the plurality of holes 205 of the collar portion 204 of the arbor bushing 102. Fastening devices, such as the fastening device 114, can be received into the aligned plurality of holes of both the plate 104 and the collar portion 204 of the arbor bushing 102 to fasten the plate 104 to the arbor bushing 102. Thus, a fastening device, such as the fastening device 114, can be inserted within each pair of aligned holes of the plate 104 and the collar portion 204 of the arbor bushing 102.

From operation 604, the method 600 proceeds to operation 606, where the pad 106 is assembled on the arbor bushing 102. According to embodiments, the center opening 110 of the pad 106 is slid over the head portion 202 of the arbor bushing 102 until the pad 106 contacts the plate 104 fastened to the arbor brushing 102. Thus, the head portion 202 of the arbor bushing 102 is inserted into the center opening 110 of the pad 106 to place the pad 106 in contact with the plate 104 fastened to the arbor bushing 102. From operation 606, the method 600 proceeds to operation 608, where the pad is fastened to the plate 104. According to embodiments, the plurality of holes 108 of the pad 106 can be aligned with the plurality of holes 306 of the plate 104. Fastening devices, such as the fastening device 116, can be received into the aligned plurality of holes of both the pad 106 and the plate 104 to fasten the pad 106 to the plate 104 to assemble the holding system 100. Thus, a fastening device, such as the fastening device 116, can be inserted within each pair of aligned holes of the pad 106 and the plate 104. From operation 608, the method 600 proceeds to operation 610, where the method 600 ends.

Figure 7:
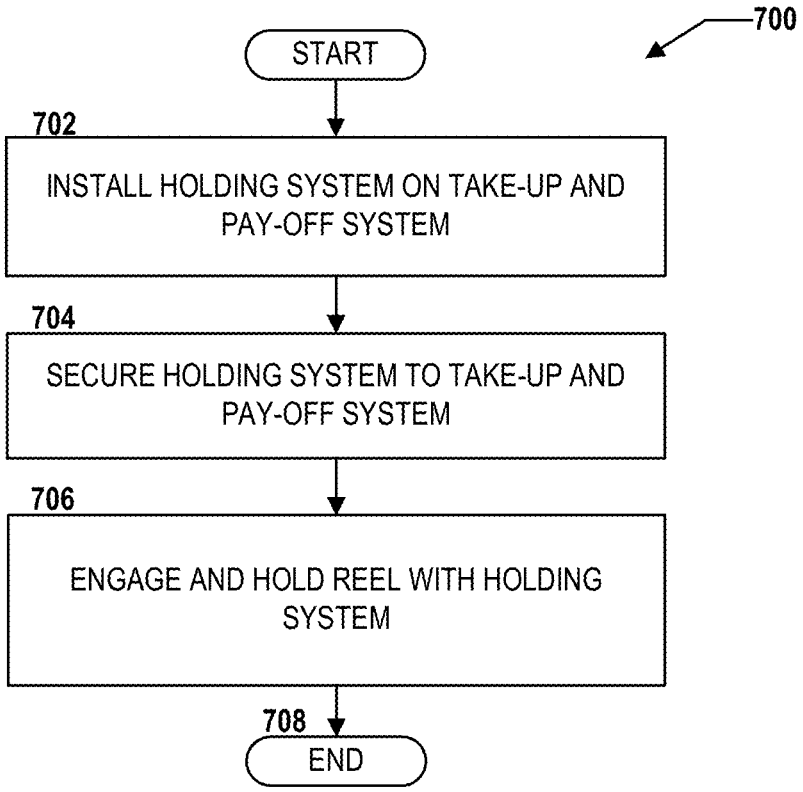
FIG. 7 is a flow diagram illustrating aspects of a method of assembling the holding system on a take-up and pay-off system.

Turning now to FIG. 7, a method 700 for installing the holding system 100 on a take-up and pay-off system, such as the take-up and pay-off system 500, and using the holding system 100 to hold a reel within the take-up and pay-off system 500 will be described, according to an illustrative embodiment. It should be understood that the operations of the methods disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the concepts and technologies disclosed herein. It also should be understood that the methods disclosed herein can be ended at any time and need not be performed in its entirety.

The method 700 begins at operation 702, where the holding system 100 is installed on the take-up and pay-off system 500. According to embodiments, the holding system 100 is positioned to insert a shaft of the take-up and pay-off system 500 within the internal bore 206 of the arbor bushing 102 of the holding system 100 to install the holding system 100 on the take-up and pay-off system 500. To allow the holding system 100 to be used on a plurality of types of take-up and pay-off systems, the diameter of the internal bore 206 of the arbor bushing 102 can be sized based on a diameter of the shaft of the particular take-up and pay-off system on which the holding system 100 is to be installed. Additionally, the length of the internal bore 206 can be sized based on a length of the shaft of the particular take-up and pay-off system on which the holding system 100 is to be installed. According to embodiments where the arbor bushing 102 includes a keyway, such as the keyway 208, the holding system 100 is aligned with reference to the shaft of the take-up and pay-off system 500 such that a key of the shaft is received within the keyway 208 as the shaft is inserted within the internal bore 206 of the arbor bushing 102 of the holding system 100. According to embodiments, the take-up and pay-off system 500 includes two shafts on which each is installed the holding system 100, illustrated as the holding systems 100A and 100B in FIG. 5.

From operation 702, the method 700 proceeds to operation 704, where the holding system 100 is secured to the shaft of the take-up and pay-off system 500. The collar portion 204 of the arbor bushing 102 can include a hole, such as the hole 210 illustrated in FIGS. 2B-2C, that can be aligned with a hole in the shaft of the take-up and pay-off system 500. A fastening device, such as for example a screw, bolt, or stud, can be received within the aligned holes of the collar portion 204 and the shaft of the take-up and pay-off system 500 to secure the holding system 100 to the shaft of the take-up and pay-off system 500. The collar portion 204 can also include a hole, such as the hole 212 illustrated in FIGS. 2B-2C for receiving a set screw. When inserted within the hole 212, the set screw can help maintain the arbor bushing 102 stationary with respect to the shaft of the take-up and pay-off system 500.

From operation 704, the method 700 proceeds to operation 706, where a reel is engaged and held by one or more of the holding systems 100. According to embodiments, a reel is positioned between the holding systems 100A and 100B installed on the take-up and pay-off system 500. The holding systems 100A and 100B can be moved inward and/or upward to align the head portion 202 of each of the holding systems 100A and 100B with arbor holes of the reel.

According to embodiments, the holding systems 100A and 100B can continue to be moved inward to allow the head portions 202 to be inserted within the arbor holes of the reel and to allow the reel to come into contact with the pad 106 of each of the holding systems 100A and 100B. According to embodiments, the head portions 202 of the holding systems 100A and 100B can be inserted within the arbor holes of the reel without requiring human involvement. As the take-up and pay-off system 500 lifts the reel and begins to rotate one or more of the holding systems 100A and 100B, the arbor bushing 102 and the pad 106 of each of the holding systems 100A-100B hold the reel and facilitate rotation of the reel. From operation 706, the method 700 proceeds to operation 708, where the method 700 ends.

The subject matter described above is provided by way of illustration only and should not be construed as limiting. Various modifications and changes may be made to the subject matter described herein without following the example embodiments and applications illustrated and described, and without departing from the true spirit and scope of the present invention, which is encompassed in the following claims.

What is claimed is:

1. A method for assembling a holding system, the method comprising:

assembling a plate on an arbor bushing, wherein the arbor bushing comprises a head portion;

attaching the plate to the arbor bushing;

assembling a pad on the arbor bushing; and attaching the pad to the plate, wherein the head portion of the arbor bushing extends outward beyond a surface of the pad.

2. The method of claim 1, wherein the plate defines a center opening, and wherein assembling the plate on the arbor bushing comprises inserting the head portion of the arbor bushing through the center opening of the plate.

3. The method of claim 2, wherein the arbor bushing further comprises a collar portion, and wherein inserting the head portion of the arbor bushing through the center opening of the plate places the plate in contact with the collar portion of the arbor bushing.

4. The method of claim 3, wherein attaching the plate to the arbor bushing comprises:

aligning a plurality of holes of the plate with a plurality of holes of the collar portion of the arbor bushing; and inserting a fastening device into each hole of the plurality of holes of the plate aligned with a respective hole of the plurality of holes of the collar portion of the arbor bushing.

5. The method of claim 1, wherein the pad comprises an opening, and wherein assembling the pad on the arbor bushing comprises inserting the head portion of the arbor bushing through the opening of the pad to place the pad in contact with the plate.

6. The method of claim 1, wherein attaching the pad to the plate comprises:

aligning a plurality of holes of the pad with a plurality of holes of the plate; and inserting a fastening device into each hole of the plurality of holes of the pad aligned with a respective hole of the plurality of holes of the plate.

7. The method of claim 1, further comprising:

inserting the head portion of the arbor bushing within an opening of a reel; and placing at least a portion of the reel in contact with the pad.

8. The method of claim 7, wherein the head portion of the arbor bushing is inserted within the opening of the reel without human involvement.

9. The method of claim 1, wherein the pad comprises a channel recessed below a surface of the pad.

10. The method of claim 1, wherein the head portion comprises a truncated cone part.

11. The method of claim 10, wherein the head portion of the arbor bushing further comprises a cylindrical part, wherein the arbor bushing further comprises an internal bore extending from proximate the truncated cone part of the head portion through the cylindrical part of the head portion, and wherein the internal bore of the arbor bushing is accessible via an opening in a collar portion of the arbor bushing.

* * * * *